United States Patent [19]

Khan

[11] 4,119,028

[45] Oct. 10, 1978

[54] REFUSE CONTAINER FOR A COMPACTOR

[75] Inventor: Aman Ullah Khan, Stevensville, Mich.

[73] Assignee: Whirlpool Corporation, Benton Harbor, Mich.

[21] Appl. No.: 776,998

[22] Filed: Mar. 14, 1977

[51] Int. Cl.[2] ..... B30B 15/32

[52] U.S. Cl. ..... 100/218; 100/229 A; 141/114; 150/0.5

[58] Field of Search ..... 100/218, 229 A; 150/0.5; 425/DIG. 44; 53/124 B, 390; 141/73, 80, 114; 221/64; 206/524.3, 822

[56] References Cited

U.S. PATENT DOCUMENTS

| | | | |
|---|---|---|---|
| 2,622,645 | 12/1952 | Pfleumer | 150/0.5 |
| 3,306,493 | 2/1967 | Szajna | 206/822 |
| 3,464,546 | 9/1969 | Thomka | 206/524.3 |
| 3,613,566 | 10/1971 | Shapleigh | 100/218 |
| 3,732,805 | 5/1973 | Moon | 100/229 A |
| 3,768,399 | 10/1973 | Martiniak | 100/229 A |
| 3,845,707 | 11/1974 | Enright | 100/229 A |
| 3,853,052 | 12/1974 | Engebretsen | 100/229 A |
| 3,869,979 | 3/1975 | Sulcek | 100/218 |

*Primary Examiner*—Billy J. Wilhite

*Attorney, Agent, or Firm*—Wegner, Stellman, McCord, Wiles & Wood

[57] ABSTRACT

A refuse compactor having a receptacle for holding the refuse during compacting in which the container is distortable and includes a pressure deformable section on at least one side normally bulging out of alignment with the adjacent area of the receptacle under conditions of substantially no pressure and a pressure member on the compactor for retaining said section deformed in substantial alignment with the side of the container during the compacting. This pressure deformable section facilitates removal of the filled container after compressing the refuse from the compactor and also facilitates removal of the compacted refuse from the container.

8 Claims, 6 Drawing Figures

REFUSE CONTAINER FOR A COMPACTOR

CROSS REFERENCE TO RELATED APPLICATION

This application is related to patent application Ser. No. 774,329, filed Mar. 4, 1977 entitled "Refuse Compactor" by Aman U. Khan and assigned to the same assignee, now U.S. Pat. No. 4,084,497.

BACKGROUND OF THE INVENTION

1. Field of the Invention

This invention relates to an open top container for use in a refuse compactor for storage and compaction of refuse therein. The container has a pressure deformable outwardly extending section in at least one upstanding wall thereof.

2. Description of the Prior Art

In the customary prior art compactors drawer-like receptacles or containers are provided which may be moved into and out of a compactor housing between a compacting position within the housing and a loading position outside of the housing. The refuse is held in a receptacle comprising an open top container for compaction therein. Preferrably this receptacle holds a paper bag in which the actual compacting occurs. When filled, the bag with the compacted trash is removed from the receptacle for disposal after the receptacle has been moved outside the housing into the loading position. Such receptacles may be constructed of metal or plastic material. A difficulty that has been encountered with these receptacles is that the removal of the compacted trash is difficult as the pressure resulting from compaction tends to distort the receptacle. U.S. Pat. No. 3,732,805 discloses a metal receptacle lacking a cross piece between the front posts thereof to facilitate removal of the filled trash bag. U.S. Pat. No. 3,845,707 shows a plastic container for compaction of trash therein.

SUMMARY OF THE INVENTION

This invention successfully overcomes the above noted problem by providing a deformable container having a pressure deformable section bulging outwardly when no pressure is applied to the container. This invention is intended to be used in compactors where supporting pressure is applied to the walls of the container under normal compacting conditions. Therefore, when the container is removed from its compacting position the transverse dimensions of the container are increased due to the outwardly bulging configuration so that the compacted trash can be easily removed from the container. The container is also adapted for use with the refuse compactor disclosed in the above noted related patent application.

DESCRIPTION OF THE PREFERRED EMBODIMENT

Figure 1:
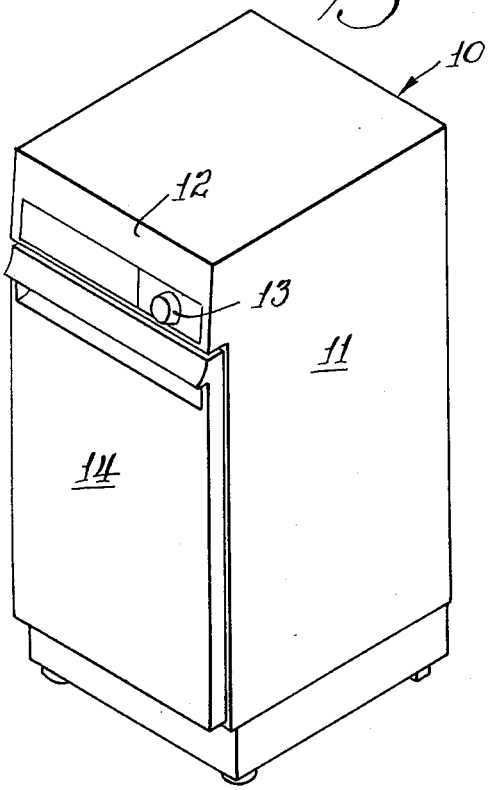
FIG. 1 is a perspective view of a trash compactor embodying the invention.

The compactor 10 of the illustrated embodiment comprises a cabinet 11 having a top panel 12 that includes a control 13 and a front door portion 14 that is part of a drawer structure which also includes a bottom platform 15 for supporting a removable open top trash receptacle 16.

Figure 2:
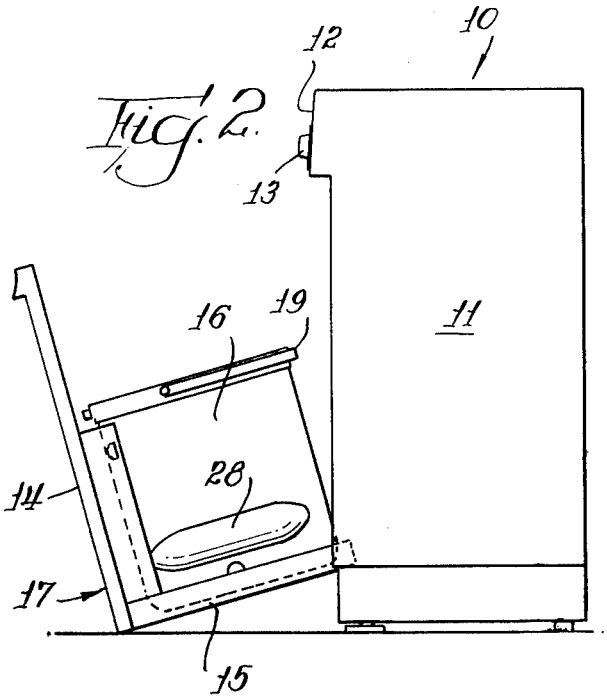
FIG. 2 is a side elevational view of the compactor with the trash container pulled outwardly of an enclosing cabinet to expose the container in which the trash is compacted.
Figure 3:
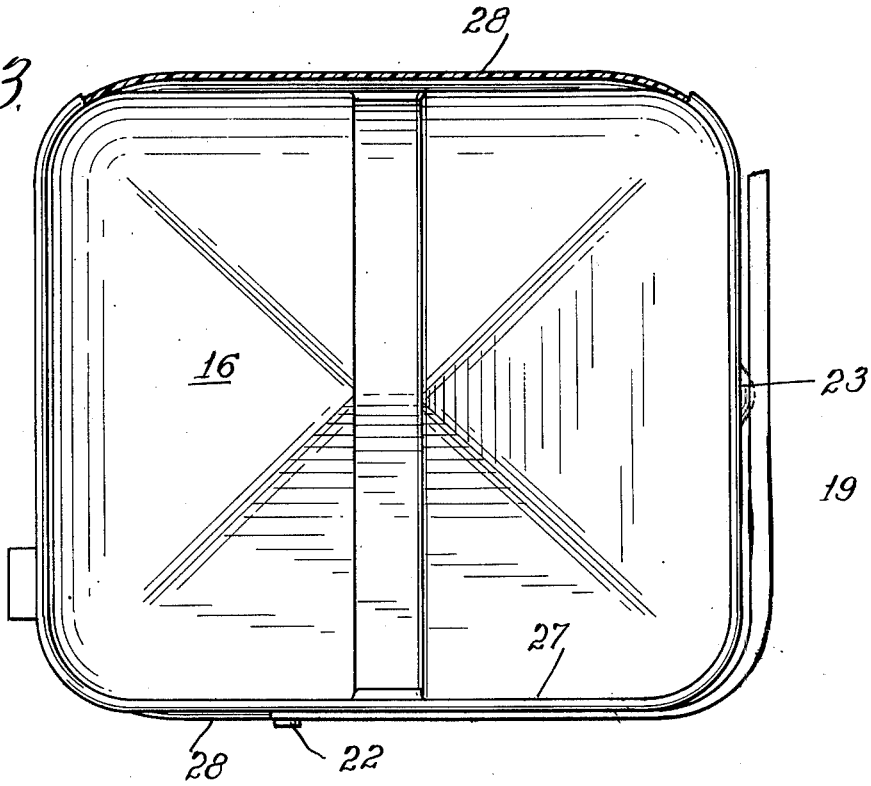
FIG. 3 is a plan view of the open top container in which the trash is held during compacting with a portion broken away for clarity of illustration.

As is shown in FIG. 2 when the drawer 17 including the front portion 14 and platform 15 is pulled out of the cabinet 11 it tips forwardly so as to provide ready access to the container 16 for removal of the compacted trash and for insertion of trash preparatory to compacting. The compacting pressure is applied by means of a ram which is not illustrated but which is indicated by the force arrow 18 of FIG. 6.

As is customary in trash compactors of this type the container 16 may be lined with a paper or similar bag in which the trash is compacted by the force 18. However, a liner bag may be omitted and trash may be compacted directly in the container. For simplicity of illustration such a liner bag is not shown in the illustrated embodiment.

It is often the case after compaction there is some difficulty in removing the container 16 from the cabinet 11 and removing the compacted trash from the container as the compaction pressure tends to distort the container. This is true both when a liner bag is used and when compaction takes place without the use of a liner bag. The present invention corrects this difficulty.

In the preferred embodiment of the present invention the container 16 is constructed of a deformable plastic material, such as a low density EVA polymer, which is strong but pressure deformable. Alternatively the container may be manufactured of metal such as low carbon sheet steel. The container as illustrated includes a customary U-shaped top handle 19 which is hinged at the ends 22 so as to embrace more than half of the upper periphery of the container. An integral deformable handle retainer 23 retains the handle in the position shown in FIG. 5 when not in use. A bottom auxiliary handle 24 having very short sides is connected to the container sides near the bottom opposite the bottom recess 25. The combination of the top handle 19 and the short bottom handle 24, which are fixed in position as by rivets 26, aids in carrying and dumping the contents of the container.

Figure 4:
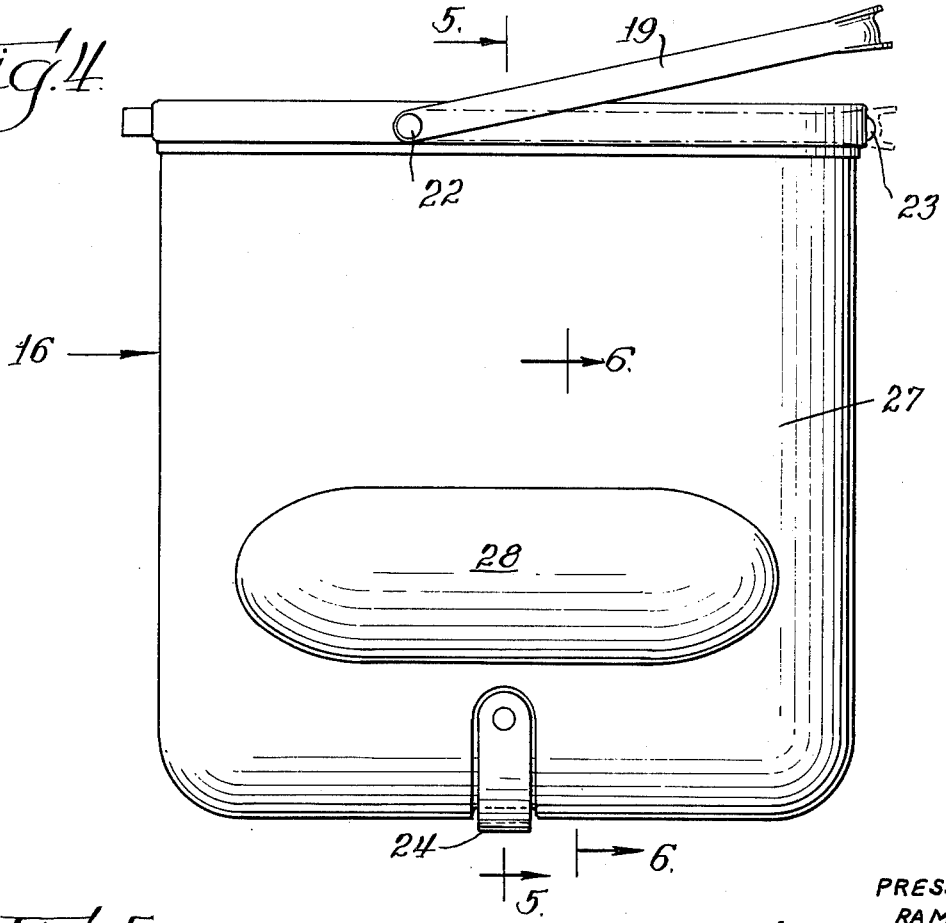
FIG. 4 is a side elevational view of the container of FIG. 3.
Figure 5:
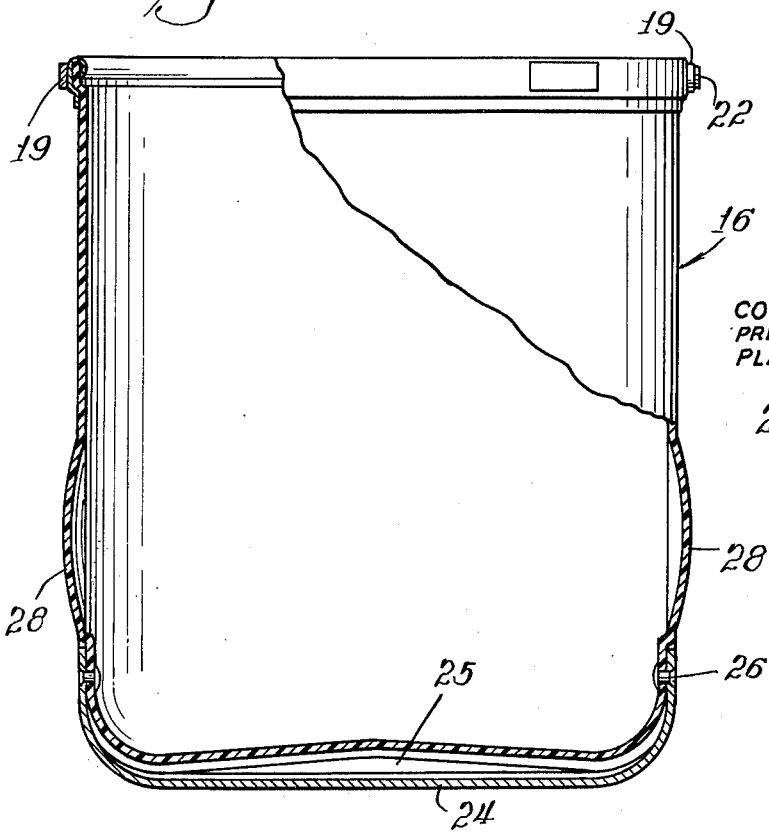
FIG. 5 is a partial sectional view taken substantially along line 5—5 of FIG. 4.

In order to remove the container 16 and contents from the cabinet 11 after compaction as well as to remove the compacted material itself, at least one side 27, of the container 16 is provided with a pressure deformable elongated section 28 or bulge that normally extends outwardly out of alignment with the plane of its side 27 as illustrated in FIGS. 2, 4 and 5. In the preferred embodiment two opposing sides each contain a deformable section 28.

Figure 6:
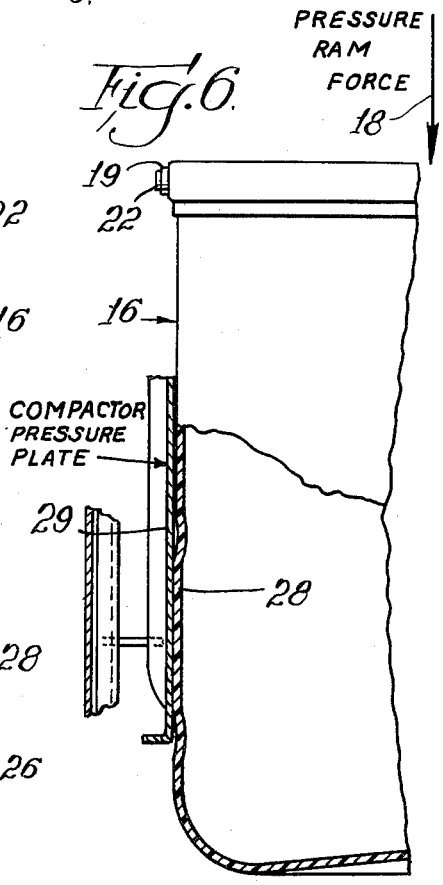
FIG. 6 is a fragmentary sectional view taken substantially along line 6—6 of FIG. 4.

Cooperating with each of the pressure deformable sections 28 is a pressure member 29, here shown in FIG. 6 as a pressure plate forming a part of the frame of the compactor 10. This pressure plate 29 which is provided for each bulge 28 presses the deformed section or bulge into substantial alignment with the side 16 in which it is located when the container is in the compacting position as shown in FIG. 6. The specific construction of the pressure plate and its actuating mechanism forms no part of the present invention. However, such structures are well known in the prior art as shown for instance in U.S. Pat. Nos. 3,613,566 and 3,869,979 and the above noted related patent application.

Although only one bulge 28 may be used in one side, if desired, it is preferred that the container include a plurality of bulges or pressure sections each in one of a plurality of sides of the container. Thus in the illustrated embodiment two of these sides are located directly opposite each other.

With the container 16 of this invention the compacted material is easier to remove from the contaner because as soon as the container is removed from the compactor and therefore the bulge 28 is moved out of contact with the pessure plate 29, the bulge immediately springs to its normal position shown more clearly in FIG. 5.

Each bulge is horizontally elongated, spans substantially the entire width of its said side and is preferrably located near the bottom of the container.

Although I have described my invention by reference to a particular illustrative embodiment, many changes and modifications of the invention may become apparent to those skilled in the art without departing from the spirit and scope of the invention.

I, therefore, intend to include within the Patent all such changes and modifications as may reasonably and properly be included within the scope of my contribution to the art.

Having described the invention, the embodiment of the invention in which an exclusive property or privilege is claimed are defined as follows:

1. For use in a refuse compactor, a storage receptacle for storing refuse to be compacted therein, said receptacle comprising an open top container having a plurality of substantially vertically straight sidewalls and a bottom wall, at least one of said sidewalls having a pressure deformable hollow inwardly opening section thereof adjacent said bottom wall and extending outwardly out of alignment with the sidewall, said hollow section extending less than the horizontal extent of the sidewalls and being constructed to be deformed into substantial alignment therewith as a result of pressure being applied inwardly against said hollow section and to assume its hollow outwardly extending configuration when outwardly unrestricted.

2. The compactor of claim 1 wherein said container sidewalls each contain a said pressure deformable section.

3. The compactor of claim 2 wherein said container is provided with a pair of said sidewalls located directly opposite to each other and provided with aligned opposed such deformable sections.

4. The compactor of claim 1 wherein said container is made of a strong, pressure deformable solid plastic material.

5. The compactor of claim 1 wherein said bulge is horizontally elongated and spans a major portion of the width of its said side.

6. In a refuse compactor;

an open top container for storing refuse to be compacted therein having a plurality of sides;

one of said sides having a flexible section extending outwardly out of alignment with said side; and a pressure applying member in said compactor for deforming said section into substantial alignment with said side during compacting of refuse.

7. The compactor of claim 6 wherein said pressure member comprises a pressure plate on the compactor engaging said section during said compacting.

8. The compactor of claim 7 wherein said container sides each contains a said pressure deformable section and each contact a said pressure plate.

* * * * *